US005334054A

United States Patent [19]

Conrad et al.

[11] Patent Number: 5,334,054

[45] Date of Patent: Aug. 2, 1994

[54] APPARATUS FOR MOUNTING A CONDUCTOR TERMINAL HOUSING ON A RAIL

[75] Inventors: Horst Conrad, Detmold; Jörg Diekmann, Bielefeld; Manfred Wilmes; Walter Hanning, both of Detmold, all of Fed. Rep. of Germany

[73] Assignee: C. A. Weidmüller GmbH & Co., Fed. Rep. of Germany

[21] Appl. No.: 8,544

[22] Filed: Jan. 25, 1993

[30] Foreign Application Priority Data

Feb. 5, 1992 [DE] Fed. Rep. of Germany ..... 4203184

[51] Int. Cl.[5] ..... H01R 9/26

[52] U.S. Cl. ..... 439/716; 439/92

[58] Field of Search ..... 439/92, 211, 716

[56] References Cited

U.S. PATENT DOCUMENTS 3,277,427 10/1966 Jurca ..... 439/716

5,022,873 6/1991 Köllmann ..... 439/716

FOREIGN PATENT DOCUMENTS 233458 1/1987 European Pat. Off. .

0396808 11/1990 European Pat. Off. ..... 439/716

7712331 4/1977 Fed. Rep. of Germany .

0629038 3/1982 Switzerland ..... 439/716

*Primary Examiner*—Khiem Nguyen

*Attorney, Agent, or Firm*—Laubscher & Laubscher

[57] ABSTRACT

An apparatus for mounting a conductor terminal including an insulated housing and a bus bar on a support rail is characterized by a solid metal contact base connected with the bus bar and adapted for electrically and mechanically connecting the bus bar with the rail. The base includes a pair of integral hook portions for clamping with the edges of the rail and at least one intermediate resilient prong extending longitudinally from the base. When the hook portions are clamped onto the rail edges, the prong is biased against the rail to retain the connector in position on the rail.

9 Claims, 2 Drawing Sheets

FIG. 1
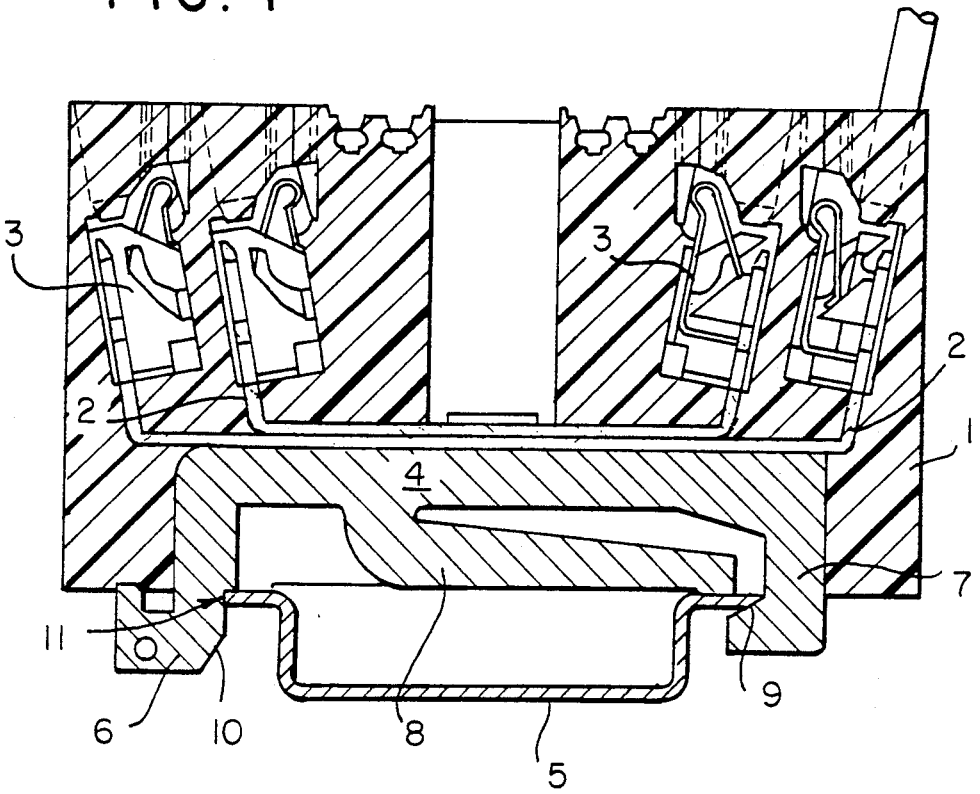
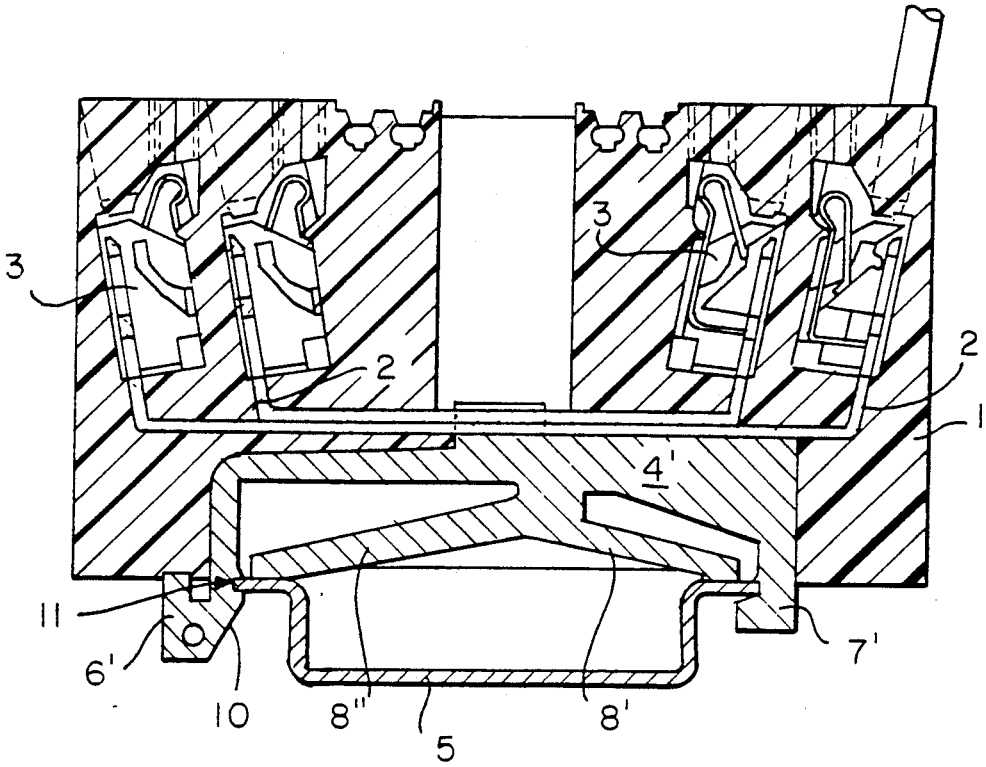
FIG. 2

APPARATUS FOR MOUNTING A CONDUCTOR TERMINAL HOUSING ON A RAIL

BACKGROUND OF THE INVENTION

The present invention relates to an apparatus for mounting a conductor terminal on a support rail. The terminal includes an insulating housing which contains conductor connectors and a bus bar. Connected with the bus bar is an improved solid metal contact base for mounting the terminal on the rail. The base includes hook portions and spring prongs that electrically and mechanically connect the terminal bus bar with the rail.

BRIEF DESCRIPTION OF THE PRIOR ART

It is known in the prior art to provide a base for a conductor terminal to electrically and mechanically connect the terminal with a support rail as shown in EPO 233,458 A1. In the known devices, the housing has a simple configuration but the base is a complicated structure that is expensive to manufacture. Typically, the prior base is a piece of bent sheet metal having two legs, with a separate relief spring connected therewith. The objective of any mounting device is to attain a reliable grip on the support rail. In the device disclosed in EPO 233,458 A1, this objective is achieved only through considerable effort and a complex structure.

Also known in the prior art and disclosed in DE GM 7712331 is a protective conductor terminal where a large metal member is provided as a connector between the bus bar of the terminal and the support rail. However, because of its shape, the metal member does not adequately connect mechanically with the rail. Accordingly, special legs are required on the terminal housing to facilitate connection with the rail. Moreover, a separate spring element is required which is mounted within the metal member. Normally, the spring element is spot welded to the metal member. This weld is often destroyed when the terminal is shifted in the longitudinal direction on the rail, whereby the terminal can not be held in position on the rail.

The present invention was developed in order to overcome these and other drawbacks of the prior devices by provided a device for mounting a conductor terminal housing on a rail which has an integral spring element and a simple configuration to provide a reliable grip on the support rail.

SUMMARY OF THE INVENTION

Accordingly, it is a primary object of the present invention to provide an apparatus for mounting a conductor terminal having an insulated housing and a bus bar on a support rail. The mounting apparatus includes a solid metal contact base connected with the bus bar and having depending hook portions at opposite ends thereof. The hook portions clamp onto opposite edges of the support rail to electrically and mechanically connect the base with the rail. A spring element comprising at least one longitudinally extending prong is integrally formed with and depends from the base intermediate the hook portions. The prong engages one edge of the rail so that when the base hook portions are clamped onto the edges of the rail, the spring element is biased against the rail to retain the conductor terminal in position on the rail.

According to another object of the invention, the base and integral spring element can be punched from a metal sheet or separated from a block of metal having a corresponding configuration to reliably and simply form the base as a massive or solid unitary contact structure.

It is yet another object of the invention to provide a pair of prongs depending from the base in opposite directions toward the hook portions. The prongs engage the opposite edges of the support rail, respectively, to further enhance the reliable positioning of the terminal on the support rail.

BRIEF DESCRIPTION OF THE FIGURES

Other objects and advantages of the invention will become apparent from a study of the following specification when viewed in the light of the accompanying drawing, in which:

FIG. 1 is a side sectional view of the apparatus for mounting a conductor terminal on a support rail according to a preferred embodiment of the invention; and FIGS. 2 and 3 are side sectional views of alternate embodiments of the invention.

DETAILED DESCRIPTION

Figure 3:
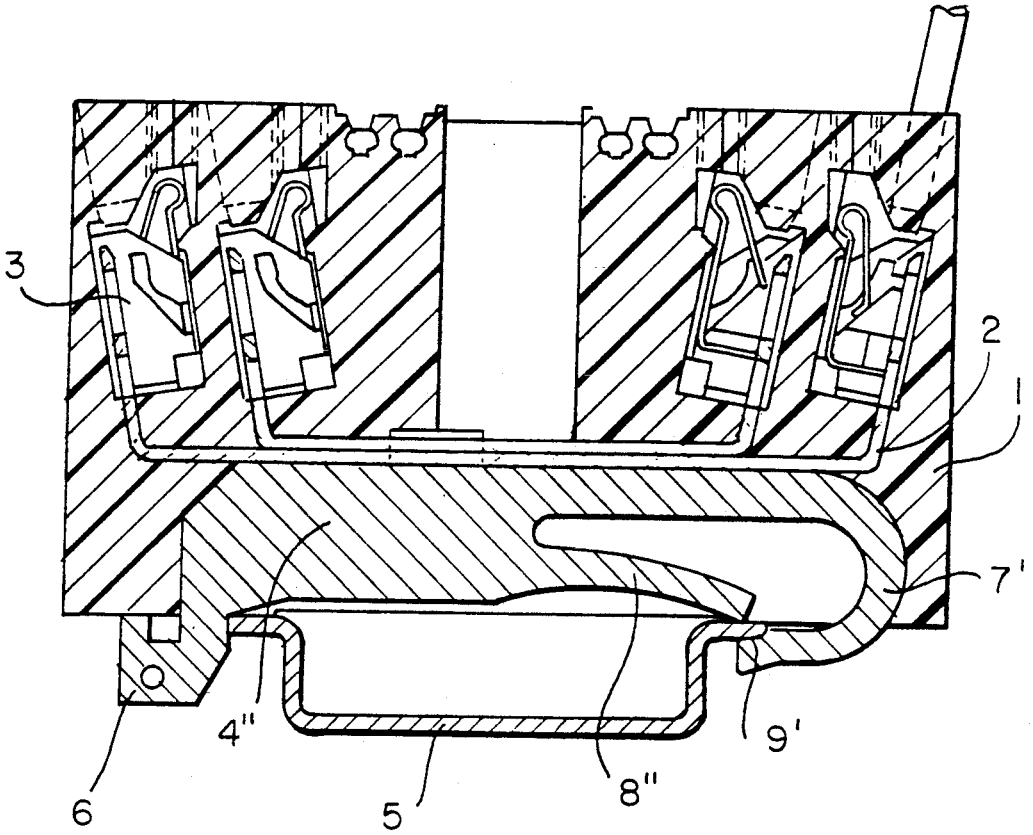

Referring now to FIGS. 1 and 2, the conductor terminal includes a housing 1 formed of insulating material such as synthetic plastic material in which are inserted bus bars 2 that are equipped with conductor connectors 3. The bus bars 2 are electrically and mechanically connected with a fastening and contact base 4, 4' which provides the electrical connection of the base bar and the mechanical connection of the terminal with a support rail 5. In grounded protective conductor terminals, the support rail functions as a grounded conductor bus bar.

The fastening and contact base includes two depending hook portions 6 and 7 that because of their shape having a spring or flex effect. A relatively long shock absorbing spring-like prong 8 is integrally formed with the base. It depends from the base adjacent the hook portion 6 and extends over the expanse of the support rail toward the other hook portion 7.

The hook portion 7 has a slanted bearing surface 9 which has a sufficient length to accommodate various sized support rails. The other hook portion 6 serves as a solid bearing and has a following surface 10 and recess 11 for receiving the free edge of the support rail 5.

When mounting the terminal on the rail, the fastening and contact base is initially positioned obliquely with the hook portion 7 engaging the edge of the support rail and the prong engaging the top surface of the edge of the support rail adjacent the hook portion 7. As the terminal is pressed toward the rail, the other end of the rail follows the surface 10 on the hook portion until it engages the recess 11. The prong 8 is biased between the rail and the base. The biasing force of the prong 8 secures the terminal in position on the rail.

With the configuration of the fastening and contact base shown in FIG. 1, support rails of different configurations may be accommodated. Moreover, because of the length of the prong, a sufficient biasing force is provided to retain the terminal in position.

In FIG. 2 there is shown an alternate embodiment of the invention. In this embodiment, the fastening and contact base 4' includes two shorter spring-like prongs 8' and 8'' that extend from the middle of the base in opposite directions toward the hook portions 6', 7'. The prongs 8', 8'' engage the top surface of the opposite edges of the support rail. As in the embodiment of FIG. 1, the hook portions have a springlike structure and cooperate with the prongs to absorb shocks. The shock-absorbing effect can thus be distributed over four spring-like elements which means that a particularly reliable elastic grip is provided for the terminal on the support rail, together with easy operation of the catch engagement on the rail.

In the embodiment shown in FIG. 3, the fastening and contact base 4'' has one hook portion 7' having an extended spring travel. For this purpose, the hook portion 7' is extended laterally beyond the support rail and is then bent back C-shaped toward the corresponding supporting rail edge. On its end that cooperates with this supporting rail edge, the hook portion 7' has an oblique bearing surface 9'. In this design, it is possible to ensure a tolerance equalization with respect to the differently dimensioned support rails because of the extended spring travel of the hook portion 7'. By virtue of this C-shaped design of hook portion 7', a horizontal force is introduced to reliably pull the fixed recess of the opposite hook element 6 against the supporting rail 5. Even if there are considerable tolerances for the supporting rail dimensions, the metallic portion of the base in each case will reliably rest on support rail 5, even without the help of the insulating material housing 1. Because of the configuration of the hook portion 7', only one prong 8''' is provided which can have a relatively short length. It extends generally from the middle of the base 4'' toward the C-shaped hook portion 7'. The hook portion 7' and prong 8''' provide sufficient resilience to securely mount the terminal on the rail.

The metal base 4, 4', 4''' can be formed by stamping it from a metal plate or by removing a section from a metal block having a corresponding configuration.

While in accordance with the provisions of the patent statute and the preferred forms and embodiments have been illustrated and described, it will be apparent to those of ordinary skill in the art that various changes and modifications may be made without deviating from the inventive concepts set forth above.

What is claimed is:

1. Apparatus for mounting a conductor terminal including an insulated housing and a bus bar on a support rail, comprising (a) a solid metal contact base connected with the bus bar and having depending hook portions at opposite ends thereof, said hook portions clamping on opposite edges of the support rail for electrically and mechanically connecting said base with the rail; and (b) spring means integrally formed with and depending from said base intermediate said hook portions, said spring means comprising at least one longitudinally extending prong for engaging one edge of the rail, whereby when said base hook portions are clamped on the edges of the rail, said spring means is biased against the rail to retain the conductor terminal in position on the rail.

2. Apparatus as defined in claim 1, wherein said at least one prong extends essentially across the width of said base between said hook portions.

3. Apparatus as defined in claim 1, wherein said spring means comprises a pair of longitudinal prongs extending from a central portion of said base in opposite directions toward said hook portions, respectively.

4. Apparatus as defined in claim 1, wherein one of said hook portions flexes outwardly for clamping on the support rail.

5. Apparatus as defined in claim 4, wherein one of said hook portions has a C-shaped configuration which extends beyond a corresponding edge of the support rail.

6. Apparatus as defined in claim 5, wherein said one hook portion includes an oblique surface adjacent said corresponding edge of the support rail.

7. Apparatus as defined in claim 4 wherein said at least one prong extends from a central portion of said base toward said one hook portion.

8. Apparatus as defined in claim 1, wherein said base comprises a section of a block of metal material, said section being removed from said block along a cross-section of said block, said base having a unique integral profile corresponding with a profile of said block.

9. Apparatus as defined in claim 1, wherein said base comprises a section punched from a planar sheet of metal, said base having a unique integral profile.

* * * * *